United States Patent [19]

Bouillet et al.

[11] Patent Number: 4,942,800

[45] Date of Patent: Jul. 24, 1990

[54] PROCESS FOR THE MANUFACTURE OF EXPLOSIVE CARTRIDGES, AND EXPLOSIVE CARTRIDGES OBTAINED USING THE SAID PROCESS

[75] Inventors: Edmond Bouillet, Wemmel; Jean-Claude Colery, Brussels; Claude Declerck, Brussels; Pierre Ledoux, Brussels, all of Belgium

[73] Assignee: Interox (Société Anonyme), Brussels, Belgium

[21] Appl. No.: 295,220

[22] PCT Filed: May 21, 1987

[86] PCT No.: PCT/BE87/00008

§ 371 Date: Nov. 29, 1988

§ 102(e) Date: Nov. 29, 1988

[87] PCT Pub. No.: WO87/07258

PCT Pub. Date: Dec. 3, 1987

[30] Foreign Application Priority Data

May 30, 1986 [FR] France ..... 86 07931

[51] Int. Cl.[5] ..... C06D 1/08; F42B 3/00; C06B 21/00; C06B 43/00

[52] U.S. Cl. ..... 86/20.1; 102/314; 102/430; 149/109.6; 86/20.14; 264/3.1

[58] Field of Search ..... 86/20.1, 20.14, 20.15; 102/314, 464, 430; 264/3.1, 3.4; 149/2, 40, 44, 109.6

[56] References Cited

U.S. PATENT DOCUMENTS

| | | | |
|---|---|---|---|
| 2,452,074 | 10/1948 | Shawley et al. | 149/2 |
| 3,047,441 | 7/1962 | Baker | 149/109 |
| 3,095,334 | 6/1963 | Scurlock | 149/21 |
| 3,574,011 | 4/1971 | Knight | 149/70 |
| 3,687,746 | 8/1972 | Bieber et al. | 149/19 |
| 3,808,062 | 4/1974 | Yokogawa et al. | 149/40 |
| 4,033,264 | 7/1977 | Bolza et al. | 149/2 |
| 4,730,534 | 3/1988 | Dupont | 86/20.12 |

FOREIGN PATENT DOCUMENTS

| | | |
|---|---|---|
| 376160 | 5/1923 | Fed. Rep. of Germany . |
| 86201 | 8/1920 | Switzerland . |

*Primary Examiner*—Howard J. Locker
*Attorney, Agent, or Firm*—Spencer & Frank

[57] ABSTRACT

A process for the manufacture of an explosive cartridge in a tubular casing, including mixing a solution containing hydrogen peroxide, an oxidizable organic material, and at least one precursor monomer of a gelling agent; and reacting the at least one precursor monomer to form macromolecules of the gelling agent in situ in the tubular casing.

13 Claims, No Drawings

PROCESS FOR THE MANUFACTURE OF EXPLOSIVE CARTRIDGES, AND EXPLOSIVE CARTRIDGES OBTAINED USING THE SAID PROCESS

FIELD OF THE INVENTION

The present invention relates to a process for the manufacture of explosive cartridges containing, in a tubular casing, an explosive composition comprising hydrogen peroxide, an oxidizable organic material and a gelling agent. More particularly, it relates to a process where the gelling agent belongs to the class of macromolecular plastic materials.

The invention also relates to the explosive cartridges obtained using the said process.

TECHNOLOGY REVIEW

There have long been known explosive compositions which contain an aqueous solution of concentrated hydrogen peroxide combined with a finely divided oxidizable combustible material and an absorbent filler material (U.S. Pat. No. 3,047,441 to A. W. Baker et al. at column 2, lines 1 to 10 and column 6, claim 1). Among the absorbent filler materials employed, mention is made of the use of gel-forming products (column 2 lines 60 to 72), as well as of thermosetting or thermoplastic synthetic resins such as urea-formaldehyde, phenol-formaldehyde or polymethyl methacrylate resins (column 2, lines 54 to 58). In an alternative form, combustible materials capable of also acting as the filler material may be employed (column 2, lines 26 to 31).

These known explosive compositions generally have the disadvantage of detonating with difficulty or of resulting only in low detonation velocities, generally below 6,000 m/s, which consequently makes them unsuitable for use as industrial explosives, particularly as mine and quarry explosives and especially for dealing with hard rocks such as basalt and granite.

SUMMARY OF THE INVENTION

The present invention aims to overcome this disadvantage of the known explosives, by providing a process for the manufacture of explosive cartridges which have high detonation velocities, of the order of 7,000 m/s and above.

To this end, the invention relates to a process for the manufacture of explosive cartridges containing, in a tubular casing, an explosive composition comprising hydrogen peroxide, at least one oxidizable organic material and at least one gelling agent belonging to the class of macromolecular plastic materials; according to the invention, in a first stage, hydrogen peroxide, the oxidizable organic material and at least one precursor monomer of the gelling agent are mixed and, in a second stage, the macromolecules of the gelling agent are synthesized in situ in the tubular casing.

DETAILED DESCRIPTION OF THE INVENTION

The process according to the invention is adapted to the manufacture of cartridges whose tubular casings are produced with materials which are usually employed for the manufacture of explosive cartridges. Examples of such materials are waxed paper, cardboard, metal, especially copper, brass, bronze, zinc, aluminium, steels of various grades and rigid plastics such as, for example, vinyl resins, polyolefins, acrylonitrile-butadiene-styrene resins and their copolymers. The composite tubular casings produced by means of several of these materials, such as sheathed metals (Cu and brass in particular), are also suitable for the process according to the invention.

Hydrogen peroxide is employed in the process according to the invention in the form of a concentrated solution of hydrogen peroxide in a solvent. "Concentrated solutions" means solutions where the weight content of hydrogen peroxide is higher than 60%. Solutions containing at least 65% by weight and up to 99.9% by weight of hydrogen peroxide are highly suitable. Solutions which contain between 70 and 90% by weight of hydrogen peroxide are preferably employed. The solvent for hydrogen peroxide may be water or an inert organic solvent. Examples of suitable organic solvents are n-butanol, acetonitrile and chloroform. Water is the preferred solvent because of its negligible cost and of its lesser risks associated with its use in the presence of concentrated solutions of hydrogen peroxide.

In the process according to the invention, the oxidizable organic material employed consists of any organic material capable of oxidizing rapidly in the presence of hydrogen peroxide or else a mixture of two or more of these materials. The materials capable of releasing large volumes of gas after oxidation are highly suitable. In order to restrict atmospheric pollution after the detonation, it is advantageous to choose organic products containing only carbon, hydrogen and oxygen.

An essential characteristic of the process according to the invention is to obtain, at the end of the first stage, a mixture which is as homogeneous as possible before proceeding with the synthesis of the macromolecules of the gelling agent. To this end, it is most particularly preferable to choose the oxidizable organic material among the organic materials belonging to the class of the products which are normally liquid at the temperature at which the first stage is carried out and which are miscible in high proportions with the hydrogen peroxide solution and to the class of the products which are soluble in a high proportion in this solution. Examples of such organic materials are the lower aliphatic alcohols such as methanol and ethanol, aliphatic diols containing fewer than 5 carbon atoms, such as ethylene glycol, and sugars such as pentoses and hexoses, especially sucrose.

In the process according to the invention, the gelling agent is a macromolecular plastic material which is synthesized in situ in the tubular casing, in the presence of hydrogen peroxide and of the oxidizable organic material, from one or more precursor monomers.

To this end, the monomer is incorporated in the mixture in the first stage of the process. Monomers which are miscible and/or soluble in the hydrogen peroxide solution at the temperature at which both stages of the process are performed are advantageously chosen.

The synthesis of the macromolecular plastic material in the tubular casings may be carried out using any method known per se. A first method is the chain polymerization method. A second method consists in reacting the functional groups carried by the monomer molecules by condensation to produce a polycondensate within the mixture contained in the tubular casing.

The plastic material thus obtained may belong to the class of thermoplastics, to that of thermosetting materials or else to that of elastomers, the difference being of no consequence.

According to the invention, it is important that the synthesis of the macromolecules should take place in the mass of the combined mixture introduced into the tubular casing. To this end, it is advantageous to choose the method of synthesis in solution. Where appropriate, the synthesis of the plastic material is carried out in the hydrogen peroxide solution. In this form of embodiment of the process according to the invention, the other constituents of the explosive mixture may be dispersed in the solid or liquid state in the hydrogen peroxide solution. It is preferable that they should be in the dissolved form in the hydrogen peroxide solution. Plastic materials which may be obtained by this method are generally well known as such. They belong to the classes of resins which are usually produced by solution polymerization. A category of resins which are particularly suitable are those obtained by aqueous solution polymerization, with the hydrogen peroxide solution then being an aqueous solution. In this category, water-soluble resins are of very particular value.

Examples of such resins which may be synthesized in the tubular casings in accordance with the process according to the invention are: polyvinyl alcohol, polyacrylamides, cationic resins including polymeric amines and quaternary ammonium polymers such as polyethyleneimines, polyalkylenepolyamines, poly(vinylbenzyltrimethylammonium) chlorides, poly)diallyldimethylammonium) chlorides, poly(glycidyltrimethylammonium) chlorides and poly(2-hydroxypropyl-1,1-N-dimethylammonium) chlorides, polyacrylic, polymethacrylic and poly-α-hydroxyacrylic acids and their alkali metal or ammonium salts, esters of polyacrylic, polymethacrylic and poly-α-hydroxyacrylic acids such as 2-hydroxyethyl methacrylate, poly(ethylene oxide)s known by the name of polyethers, poly(N-vinyl-2-pyrrolidone), polyvinyl ether homopolymers of alkyl vinyl ethers, copolymers of maleic anhydride with styrene or with ethylene and the surface-active polymers known by the name of "polysoaps" such as poly(2-vinylpyridine) and poly(4-vinylpyridine) and their alkylated derivatives, as well as polyionenes.

Epoxy resins constitute another class of resins which can be employed within the scope of the invention.

The preferred resins are those which contain only carbon, hydrogen and oxygen.

By virtue of its organic nature, the gelling agent itself also constitutes an oxidizable material. In an alternative embodiment of the process according to the invention, the hydrogen peroxide is mixed, in the first stage, with the precursor monomer of the gelling agent, to the exclusion of all other oxidizable organic materials.

According to the invention, it is advantageous for the explosive power of the cartridges manufactured that the explosive obtained in the tubular casings at the end of the second stage should have a sufficient density which is higher than 1.2 kg/dm$^3$. The best results are obtained when the density of this explosive is higher than 1.35 kg/dm$^3$.

In the process according to the invention, a small proportion of additives is incorporated in the mixture, generally in the first stage, this proportion being generally lower than 5% by weight of this mixture. The principal purpose of these additives is to stabilize the hydrogen peroxide against slow decomposition into water and oxygen. Materials which are known for stabilizing concentrated hydrogen peroxide solutions, such as phosphates, stannates and sequestrants for heavy metals, of an organic or inorganic type, are employed for this purpose. Other additives may be added to the mixture to impart to the explosive material manufactured special properties such as a lower friction or impact sensitivity, a reduced tendency to sweat, improved mechanical properties such as plasticity, and resistance to frost and to low temperatures in general.

The proportions of the various constituents to be employed in the mixture depend, at the same time, on the nature of the oxidizable organic material, on that of the precursor monomer of the plastic material forming the gellant, and on the solvent(s) present. They can easily be determined by laboratory formulation tests. As a general rule, the formulation of the mixture must be adapted so that the respective quantities of hydrogen peroxide, on the one hand, and of the materials capable of being oxidized (which include the oxidizable material, the plastic material and any organic solvent present), on the other hand, are not too remote from the stoichiometric quantities corresponding to the chemical reactions of oxidation by hydrogen peroxide.

The explosives industry characterizes the departure from this stoichiometry by the concept of oxygen balance, expressed in % $O_2$ and established as follows in the case of an explosive containing only carbon, hydrogen and oxygen and also nitrogen if desired:

$$\% \, O_2 = \frac{-1600\left(2c + \frac{h}{2} - o\right)}{\text{mean molecular mass}}$$

where c, h and o are the respective proportions of the carbon, hydrogen and oxygen atoms in the empirical chemical formula of the explosive, such as provided by elemental analysis.

Good results have been obtained by adjusting the proportion of the components of the mixture so that the oxygen balance should lie within the range of values from −80 to +100%. The best results are obtained using cartridges in which the oxygen balance of the explosive is between −20 and +30%.

To this end, the mixture produced in the first stage of the process generally contains a weight proportion of 50 to 95% of a concentrated solution of hydrogen peroxide in water or in an organic solvent, 2 to 40% of oxidizable organic material, 2 to 40% of precursor monomer of the plastic material and 0 to 5% of additives.

The best results have been obtained using mixtures in which the weight proportions comprise 65 to 85% of concentrated solution of hydrogen peroxide, 5 to 30% (preferably 5 to 20%) of oxidizable organic material, 5 to 30% (preferably 5 to 20%) of precursor monomer of the plastic material and not more than 1% (preferably 0.2%) of additives, such as defined above.

In a particular embodiment of the process according to the invention, which is preferred, the oxidizable organic material, the solvent, the precursor monomer of the plastic material and the respective proportions of these constituents and of hydrogen peroxide are chosen so that the mixture obtained in the first stage comprises only a single homogeneous liquid phase with low dynamic viscosity, for example below 1,500 Pa.s, preferably below 1,000 Pa.s.

In an alternative form of the process according to the invention, the first stage of mixing is performed outside the tubular casing, the synthesis of the macromolecules of the gelling agent is then initiated and then the mixture is introduced into the tubular casing where the gelling of the explosive composition takes place. The initiation of the synthesis of the macromolecules is carried out using any conventional methods which are well known in the plastics industry, for example by addition of a peroxide polymerization initiator, or by irradiation of the mixture by means of a visible or ultraviolet radiation of an appropriate frequency.

In this alternative form of embodiment, the first stage of mixing may be carried out in any kind of mixing apparatus capable of, homogenizing liquids and of dissolving solid materials therein, where appropriate, such as vessels with rotary stirrers, planetary mixers, pneumatic mixing methods or else static mixers.

The order in which the various constituents are introduced into the mixture must be adapted to the nature of the constituents and to type of mixer. In most cases, the oxidizable organic material is first mixed with the stabilizing additive where appropriate. Hydrogen peroxide is then added progressively into the mixer, followed by the precursor monomer of the plastic material.

The order of addition of hydrogen peroxide and of the monomer may also be reversed so as to end the first stage of the process according to the invention by introducing the hydrogen peroxide solution.

The invention also relates to the explosive cartridges obtained by means of the process described above.

The explosive cartridges according to the invention find advantageous applications as industrial explosives in confined atmospheres, especially in mines and quarries. When they contain only carbon, hydrogen and oxygen, their use makes it possible to perform underground firing which does not contaminate the surrounding atmosphere and which thus increases the safety of the operating personnel, while permitting high firing rates and consequently an improved profitability in use.

Furthermore, the explosive cartridges according to the invention have a particularly low tendency to sweat.

Special features of the invention will become apparent from the following examples, which describe, without any limitation being implied, processes of manufacture of the explosive cartridges according to the invention, as well as tests for comparison with processes prior to the invention.

EXAMPLE 1R (reference test)

293.8 g of ethylene glycol and 1.3 g of diethylenetriaminepenta(methylenephosphonic) acid (Briquest 543-45 AS, registered trademark of Albright & Wilson) were introduced into a stainless steel planetary mixer of registered trademark Hobart, model N-50. After the mixing of the constituents was started, 993.2 g of an aqueous solution of hydrogen peroxide containing 85% by weight of $H_2O_2$ was then introduced in the form of a slow and continuous stream, followed by 13 g of polyacrylic acid (Carbopol 934, registered trademark of B.F. Goodrich Cy). The introduction of all the components of the mixture took approximately 15 min.

Mixing was then continued for 1 hour, and then the mixture was transferred by pouring into PVC tubular cartridge casings with an internal diameter of 33 mm, a wall thickness of 2 mm and a length of 310 mm. The casings contained two detectors intended to measure the detonation velocity, 150 mm apart, one of the detectors being at a distance of 150 mm from an end of the cartridge adjoining the primer. These detectors were twisted copper wire sensors 0.2 mm in diameter, covered with a fine layer of enamel, the whole sensor being placed in a PVC sheath with an external diameter of 1.5 mm, the purpose of which being to insulate it from the explosive mixture.

An electrical detonator with a charge of 0.6 g of PETN (pentaerythritol tetranitrate or penthrite) in a copper case 7 mm in diameter was then immersed, as a primer, in the cartridge which was then carefully closed again.

The density of the explosive material obtained after complete gelling was between 1.27 and 1.28 kg/dm$^3$ for all the cartridges tested.

Measurement of the detonation velocity was carried out by determining the time taken by the shock wave to travel the known distance of 150 mm separating the two detectors.

The measurement was carried out by suspending the cartridge horizontally 1 m above ground. In this measurement method, in the event of explosion, the copper wires of the detectors are abruptly short-circuited at the precise instant of the passage of the shock wave. The short-circuit triggers a pulse generator which delivers a steep-edged electrical pulse of sufficient amplitude to trigger an electronic chronograph. The first pulse starts the chronograph, the second, produced by the second sensor, stops it.

The firing of a cartridge prepared according to the method described above did not give rise to detonation; it was, in fact, impossible to measure any detonation velocity whatever, only the first sensor having been short-circuited.

Repetition of the experiment with another cartridge produced identical results.

EXAMPLE 2R (reference test)

262.6 g of methanol and 1.3 g of diethylenetriaminepenta(methylenephosphonic) acid (Briquest 543-45 AS) were introduced with stirring into a 1,800 ml beaker equipped with a rotary stirrer consisting of a glass paddle. After a few minutes, 1,024.4 g of an aqueous solution of hydrogen peroxide containing 85% by weight of $H_2O_2$ was introduced in a slow and continuous stream. 3.80 g of crosslinked polyacrylamide (Aquasorb PR 3005, registered trademark of SNF Floerger) were then placed in the bottom of the tubular casings.

After 376.2 g of the liquid mixture of methanol and of stabilized hydrogen peroxide were transferred by pouring into each casing, the contents of the casings were carefully mixed, the cartridges were closed and were stored for 24 hours at ambient temperature, during which the gelling of the mixture was completed. The same test to measure the detonation velocity as in Example 1R was then carried out.

The density of the explosive composition obtained was between 1.20 and 1.21 kg/dm$^3$.

Out of the two firings carried out, only the first yielded a low measurable detonation velocity of 2,867 m/s, the second having behaved as in the case of Example 1R, namely the absence of short-circuiting of the second-sensor.

EXAMPLE 3R (reference test)

A mixture of 327.6 g of sucrose, 0.86 g of diethylenetriaminepenta(methylenephosphonic) acid (Briquest 543-45 AS), and 959.4 g of an aqueous solution of hydrogen peroxide containing 85% by weight of $H_2O_2$ was prepared according to the same process as that of Example 2R. 3.8 g of crosslinked polyacrylamide (Aquasorb PR 3005) was then introduced into the bottom of the tubular casings.

After 376.2 g of the liquid mixture of sucrose in solution in the stabilized hydrogen peroxide were transferred by pouring into each casing, the contents of the casings were carefully mixed, the cartridges were closed and were stored for 24 hours at ambient temperature. The cartridges were then subjected to the same detonation velocity measurement test as in Examples 1R and 2R.

The density of the explosive composition filling the cartridges was 1.41 kg/dm3. No detonation velocity could be measured during two repeated firings; only the first sensor was short-circuited during the first firing, none of the sensors triggered on second firing.

EXAMPLE 4

(according to the invention)

195 g of sucrose and 0.39 g of dipicolinic acid were introduced into a 1,800 ml beaker. After stirring for a few minutes, 975 g of an aqueous solution of hydrogen peroxide containing 85% by weight of $H_2O_2$ and 130 g of acrylic acid monomer were then introduced successively into the beaker, in the form of a slow and continuous stream.

After mixing for 15 minutes, polymerization of acrylic acid was initiated by irradiation with ultraviolet light for 1 hour 40 min.

The mixture was then transferred by pouring into PVC cartridges similar to those employed in Examples 1R to 3R and the cartridges were stored for 24 hours, during which the polymerization of acrylic acid took place and was completed.

The density of the explosive composition contained in the cartridges was 1.38 kg/dm$^3$.

Measurements of detonation velocity were then carried out.

The two firings carried out produced a high and reproducible detonation velocity: 7,042 m/s in the case of the first firing and 7,009 m/s for the second.

The cartridges prepared by following the process in accordance with the invention are characterized by a stable detonability, with high speed and are endowed with a relatively high power.

EXAMPLE 5

The explosive materials obtained in Examples 1R, 2R and 4 were tested for sweating under mechanical pressure. The test consists in placing a 15 mm diameter sausage of the material to be tested, previously wrapped in gauze, in a tubular cavity pierced with 20 holes 0.5 mm in diameter. A pressure of 1.2 bar is then applied to the sausage by means of a plunger. The minimum time for the appearance of the first droplets of exudate at the orifice of one of the holes is noted. The test is repeated 3 times.

The results are given in Table I which follows:

| Material of the example No. | Ambient temperature, °C. | Time for appearance of the 1st drop of exudate, s | | |
|---|---|---|---|---|
| | | Test 1 | Test 2 | Test 3 |
| 1R | 17 | <1 | <1 | <1 |
| 2R | 16 | <2 | <2 | <2 |
| 4 | 19 | 660 | 810 | 640 |

These results show the marked superiority of the material obtained in Example 4 following the process according to the invention when compared with the materials obtained by following the known processes of Examples 1R and 2R.

EXAMPLE 6

Into a 2,000 ml beaker were introduced: 186 g of ethylene glycol, 0.6 g of dipicolinic acid, 0.6 g of a free radical scavenger (butylhydroxytoluene of registered trademark Ionol CP of Shell) and 0.24 g of a sequestrant (heptasodium salt of diethylenetriaminepentamethylenephosphonic acid containing 25% by weight of active substances, of registered trademark Dequest 2066 of Monsanto).

After stirring for a few minutes, 924 g of an aqueous solution of hydrogen peroxide containing 85% by weight of $H_2O_2$ were introduced into the beaker, in the form of a slow and continuous stream, followed successively by 72 g of acrylic acid monomer and 18 g of tripropylene glycol diacrylate (TPGDA).

After mixing for 10 minutes, the polymerization of acrylic acid and of TPGDA was initiated by irradiation with ultraviolet light for 240 min.

The mixture was then transferred by pouring into PVC cartridges similar to those employed in Examples 1R to 3R and 4 and the cartridges were stored for 20 hours.

The density of the explosive composition contained in the cartridges was 1.35 kg/dm$^3$.

Measurement of detonation velocity was then carried out as in Examples 1R to 3R and 4.

The two firings performed yielded a high and reproducible detonation velocity: 6,760 m/s for the first firing and 6,880 m/s for the second.

We claim:

1. Process for the manufacture of explosive cartridges containing, in a tubular casing, an explosive composition comprising hydrogen peroxide, at least one oxidizable organic material and at least one gelling agent belonging to the class of macromolecular plastic materials, comprising the steps of:

mixing (a) a solution containing hydrogen peroxide of at least about 60 weight %, (b) oxidizable organic material and (c) at least one precursor monomer of the gelling agent; and reacting said at least one precursor monomer to form macromolecules of the gelling agent in situ in the tubular casing.

2. Process according to claim 1, wherein said at least one oxidizable organic material is a precursor monomer of the gelling agent.

3. Process according to claim 1, wherein the mixing step is performed outside the tubular casing, the synthesis of the macromolecules of the gelling agent is initiated, and the mixture is then introduced into the tubular casing.

4. Process according to claim 1 wherein the organic material and the monomer are chosen so that the mixture obtained in the mixing step comprises a single homogeneous liquid phase with a dynamic viscosity below 1.000 Pa.s.

5. Process according to claim 1 wherein the gelling agent is chosen from thermoplastic polymers obtained by chain polymerization.

6. Process according to claim 5, wherein the gelling agent is polyacrylic acid.

7. Process according to claim 1 wherein the oxidizable organic material contains only carbon, hydrogen and oxygen.

8. Process according to claim 7, wherein the oxidizable organic material is sucrose.

9. Process according to claim 1, wherein the density of the explosive composition at the end of the reacting step is higher than 1.35 kg/dm$^3$.

10. Process according to claim 1 wherein a stabilizing agent for hydrogen peroxide is incorporated in the mixing step.

11. Process according to claim 10, wherein in the mixing step, the resulting mixture comprises from 65 to 85% by weight of an aqueous solution comprising about 85% by weight of hydrogen peroxide; 5 to 20% by weight of sucrose; 5 to 20% by weight of acrylic acid; and 0.01 to 0.2% by weight of dipicolinic acid.

12. Explosive cartridge obtained using the process according to claim 1.

13. Process according to claim 1, wherein said mixing step is performed directly in the tubular casing.

* * * * *